United States Patent [19]

Sullivan

[11] 4,429,640

[45] Feb. 7, 1984

[54] SUBMERGED SCRAPER CONVEYOR FURNACE TRANSITION PIECE

[75] Inventor: Robert P. Sullivan, Chattanooga, Tenn.

[73] Assignee: Combustion Engineering, Inc., Windsor, Conn.

[21] Appl. No.: 392,411

[22] Filed: Jun. 25, 1982

[51] Int. Cl.[3] ..... F23J 1/00

[52] U.S. Cl. ..... 110/165 R

[58] Field of Search ..... 110/165 R, 166, 171; 126/242

[56] References Cited

U.S. PATENT DOCUMENTS

| | | | |
|---|---|---|---|
| 2,594,976 | 4/1950 | Mytling | 110/165 R |
| 3,440,978 | 4/1969 | Magol | 110/165 R |
| 3,834,328 | 9/1974 | Blazewicz et al. | 110/165 R |
| 3,857,344 | 12/1974 | Coulter | 110/165 R |
| 4,227,468 | 10/1980 | Buchmüller et al. | 110/165 R |
| 4,300,457 | 11/1981 | Moore | 110/165 R |

FOREIGN PATENT DOCUMENTS

| | | | |
|---|---|---|---|
| 1930432 | 12/1970 | Fed. Rep. of Germany | 110/171 X |
| 2620836 | 11/1977 | Fed. Rep. of Germany | 110/165 R |
| 955362 | 4/1964 | United Kingdom | 110/166 |

*Primary Examiner*—Albert J. Makay

*Assistant Examiner*—David E. Helmbold

*Attorney, Agent, or Firm*—Robert L. Olson

[57] ABSTRACT

In combination, a top-supported furnace (10) in which an ash-bearing fuel is burned, opening means (12) in the furnace bottom, a bottom supported tank (16) open at its upper end and containing water (18) positioned beneath the furnace opening means (12), into which the ash from the furnace (10) falls, means (20) for removing the ash from the tank (16), an intermediate transition piece (26) hydraulic drive means (30) carried by the tank (16) for moving the transition piece (26) between a first position spaced from the furnace bottom, and a second position in engagement with the furnace bottom, means (32, 34) for removably sucuring the transition piece (26) to the furnace bottom, seal means (36) which completely surround the furnace bottom for sealing the space between the transition piece (26) and the furnace bottom when the transition piece (26) is in its second position, stop means (38) for limiting the movement of the transition piece (26) towards the furnace bottom to prevent the seal means (36) from becoming crushed, and plate means (40) carried by the transition piece (26) which completely surround the furnace bottom which coacts with a body of water carried by the tank (16) for forming a water seal between the furnace bottom and the tank (16).

3 Claims, 3 Drawing Figures

SUBMERGED SCRAPER CONVEYOR FURNACE TRANSITION PIECE

BACKGROUND OF THE INVENTION

In coal-fired steam generators, the manner in which the ash is handled and disposed of is an item of considerable importance. One means used today for continuously removing ash and slag which falls through an opening in the furnace bottom is a scraper conveyor which is submerged in a tank of water. When the unit is shut down for periodic maintenance, it is desirable to be able to move the entire scraper conveyor unit, including the tank in which it is housed, from beneath the furnace so that it can be easily worked on, and so that it can be replaced with another unit if major repair is required.

A water seal is generally provided for preventing the atmosphere from being exposed to the furnace interior. This consists of a plate extending down and surrounding the furnace bottom opening, which plate extends into the submerged scraper conveyor tank, which tank is filled with water, thus forming a water seal. This type of seal is provided because it allows the furnace growth relative to the submerged scraper conveyor unit caused by thermal expansion. Large furnaces are generally top-supported, so that they are free to expand in a downward direction when the unit is first started up. This growth can be on the order of 10–12 inches from the cold to the hot condition. The above provides the problem of how to be able to quickly remove the submerged scraper conveyor unit from beneath the furnace when the unit is shut down for maintenance. In the past, it has been necessary to allow the unit to cool down to a point where workmen can unbolt the seal plate from the furnace bottom. This cooling and unbolting time is considerable and can cause the entire steam generator to be down for lengthy maintenance periods.

SUMMARY OF THE INVENTION

In accordance with the invention, a bottom-supported submerged scraper conveyor unit is provided beneath a top-supported coal-fired furnace, and a water seal is provided therebetween to prevent the furnace gases from escaping to the atmosphere. The water seal is formed by a transition piece located between the furnace bottom and the water-filled tank containing the scraper conveyor. The transition piece is bolted to the furnace bottom, and has a sealing plate extending downwardly into either (1) the water in the scraper conveyor tank, or (2) a water-filled trough carried by the scraper conveyor tank, to thus form a water seal. A hydraulic lifting or drive apparatus carried by the scraper conveyor tank is used to permit detachment of the transition piece from the furnace bottom when maintenance work is to be done. The transition piece, along with the scraper conveyor tank, can then be moved from beneath the furnace bottom for repair or replacement.

DESCRIPTION OF THE PREFERRED EMBODIMENT

Figure 1:
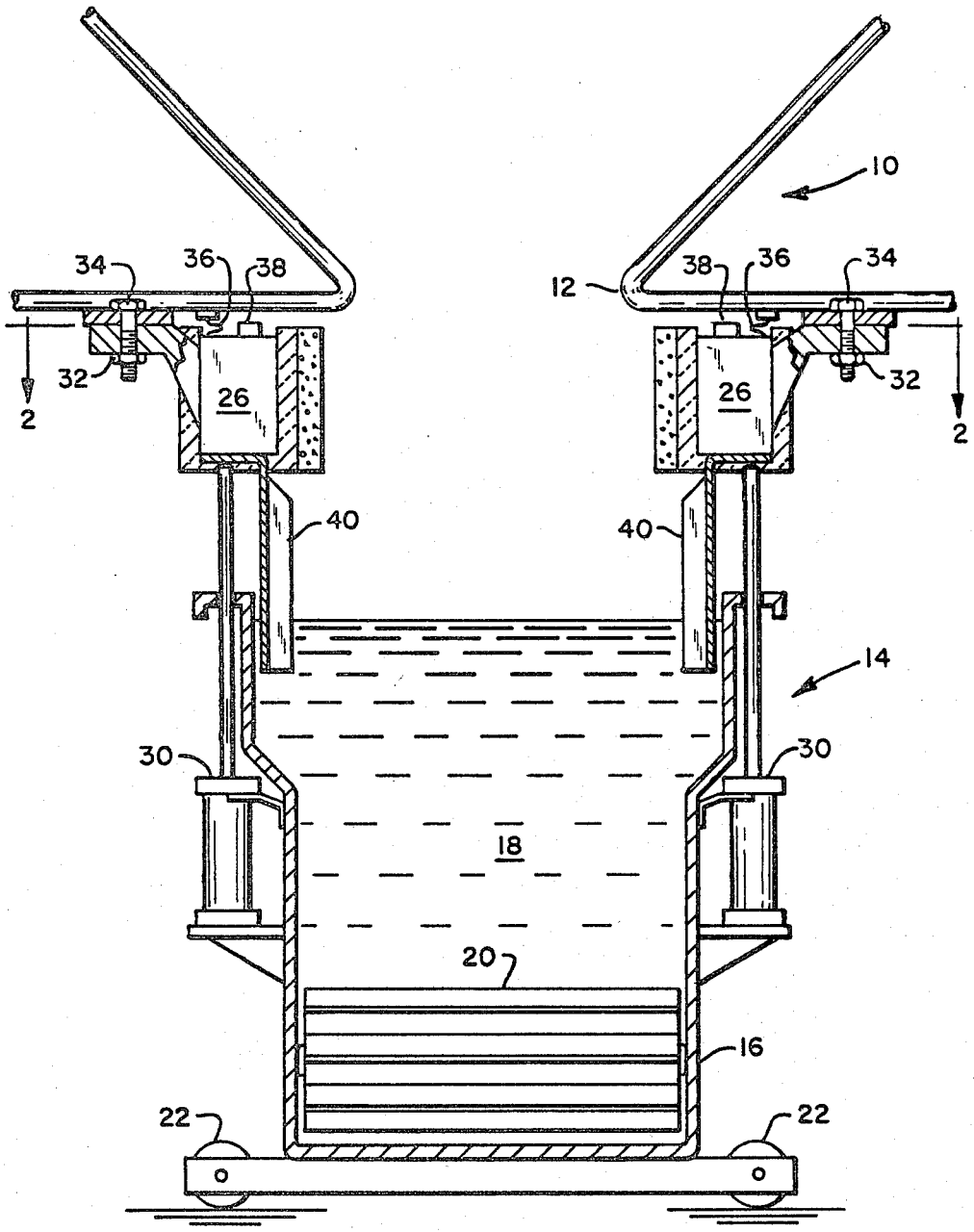
FIG. 1 is a sectional side view of a submerged scraper conveyor unit beneath a furnace, taken on lines 1—1 of FIG. 2, constructed in accordance with the present invention.

Looking now to FIG. 1, numeral 10 designates a furnace of a steam generator in which coal is burned. The furnace is top-supported in any suitable and well known manner, so that it is free to thermally expand downwardly during startup. Molten ash and slag are discharged through the furnace bottom opening 12, and falls into the submerged scraper conveyor unit 14. The tank 16 is filled with water 18, and contains a conveyor belt 20 having integral scraper blades in the bottom thereof, by means of which the cooled ash and slag is continuously removed from the tank. The conveyor carries the clinkers to the end of the tank, where they can be discharged into trucks or onto a mechanical conveyor (not shown) and transported away. A portion of the water in the tank is constantly removed and replenished (while maintaining a given water level) to maintain the main body of water at a temperature not exceeding 160 F. The tank 16 is mounted on wheels 22, so that it can be removed from beneath the furnace when maintenance work is to be done.

A water seal permits thermal expansion of the top-supported furnace 10 while preventing exposure of the atmosphere to the furnace interior. The water seal is formed by plate 40 which is secured to a transition piece 26 and extends down into the water 18. The plate 40 extends around the entire periphery of opening 12, so as to completely seal the opening between the furnace bottom and the tank 14.

Figure 2:
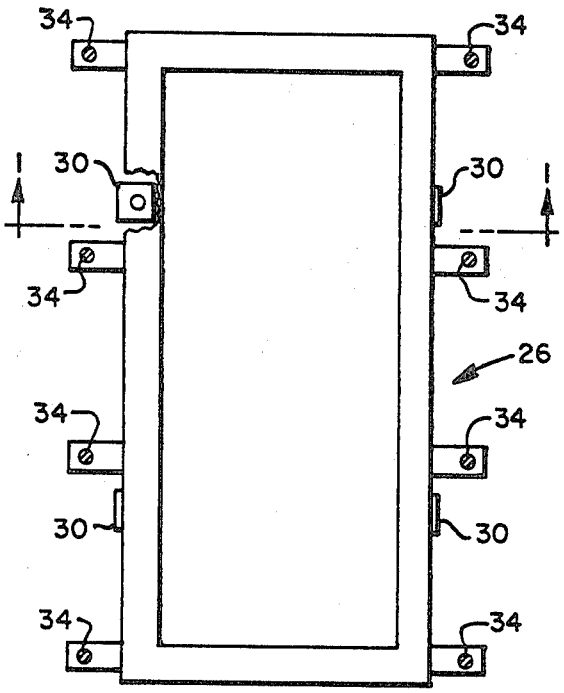
FIG. 2 is a view taken on lines 2—2 of FIG. 1.

The transition piece 26 is carried by the tank 14, and can be moved between a first upper position and a second lower position by four hydraulic drives 30 (which consist of piston and cylinder arrangements). When the transition piece is in its first upper position, it can be removably secured to the furnace bottom by a plurality of nuts and bolts 32, 34. As seen in FIG. 2, there are four nut and bolt arrangements along each side of the transition piece 26.

The transition piece has a sealing member 36 in the form of a flexible metal member, which seals against the furnace bottom 12 when the transition piece 26 is secured thereto. The sealing member 36 extends around the entire periphery of 12. A stop member 38 limits the upward movement of the transition piece 26 when it is moved to its upper position, to prevent the flexible seal from being crushed or permanently deformed.

The transition piece 26 has secured thereto a plate 40 which extends around the entire periphery of opening 12. This metal plate 40 extends down into the water 18 in tank 16 thus forming a water seal, preventing exposure of the furnace interior to the atmosphere, while permitting thermal expansion of the top-supported furnace 10.

Figure 3:
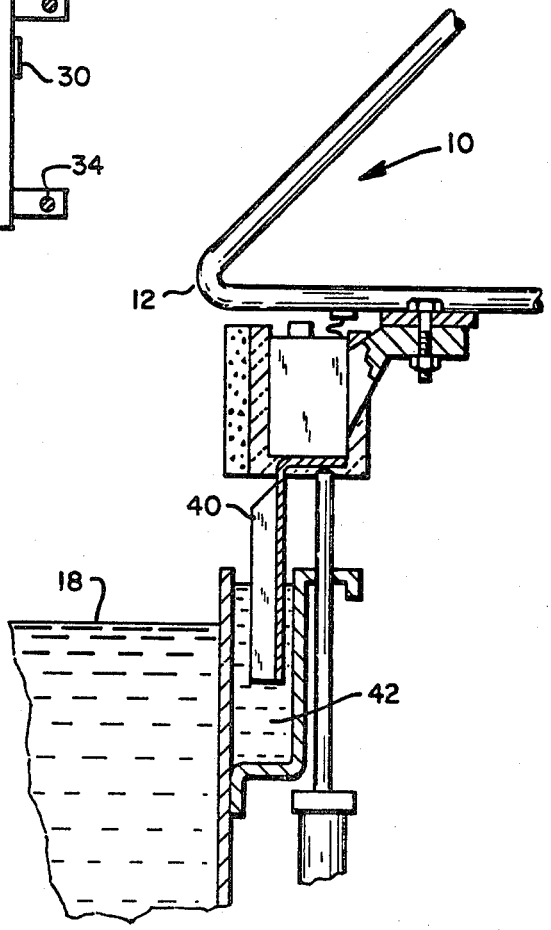
FIG. 3 is a sectional side view of a submerged scraper conveyor unit beneath a furnace constructed in accordance with an alternative arrangement of the present invention.

FIG. 3 shows an alternative arrangement of the invention. It is the same as the unit shown in FIG. 1, with the exception that the water seal is formed differently. In the FIG. 3 embodiment, the tank 16 carries a water filled trough 42, and the plate 40 extends down into the water in trough 42 to form the water seal. Again, water is continuously added to the trough to keep a constant water level therein.

The manner in which the unit operates should now be apparent. When it is desired to move the submerged scraper conveyor unit 14 from beneath the furnace 10, the nuts and bolts 32, 34 are loosened, after the hydraulic drives 30 have been actuated to their upper position. The hydraulic drives are then lowered, causing the transition piece 26 to move downwardly therewith. The tank 14, carrying transition piece 26, can then be rolled out from under the furnace for repair or replacement. When the unit is ready to be placed in operation again the reverse procedure is run.

I claim:

1. In combination, a top-supported furnace in which an ash-bearing fuel is burned, opening means in the furnace bottom, a bottom supported tank open at its upper end and containing water positioned beneath the furnace opening means, into which the ash from the furnace falls, means for removing the ash from the tank, an intermediate transition piece, drive means carried by the tank for moving the transition piece between a first position spaced from the furnace bottom, and a second position in engagement with the furnace bottom, means for removably securing the transition piece to the furnace bottom, flexible seal means which completely surround the furnace bottom for sealing the space between the transition piece and the furnace bottom when the transition piece is in its second position, stop means for limiting the movement of the transition piece towards the furnace bottom to prevent the seal means from becoming crushed, and plate means carried by the transition piece which completely surround the furnace bottom which coacts with a body of water carried by the tank for forming a water seal between the furnace bottom and the tank.

2. The combination set forth in claim 1, wherein the water forming the water seal is the body of water in the tank.

3. The combination set forth in claim 1, including a trough supported on the tank and completely surrounding the opening means in the furnace bottom, said trough being filled with water, and the plate means extending down into the water in the trough to form the water seal between the furnace bottom and the tank.

* * * * *